US006766586B2

(12) United States Patent
Brooks

(10) Patent No.: US 6,766,586 B2
(45) Date of Patent: Jul. 27, 2004

(54) BUILDER'S SQUARE

(76) Inventor: Robert Brooks, 140 E. Hartsdale Ave., Hartsdale, NY (US) 10530

( * ) Notice: Subject to any disclaimer, the term of this patent is extended or adjusted under 35 U.S.C. 154(b) by 0 days.

(21) Appl. No.: 10/271,224

(22) Filed: Oct. 15, 2002

(65) Prior Publication Data

US 2004/0068883 A1 Apr. 15, 2004

(51) Int. Cl.[7] ..... B43L 13/02; B27G 23/00
(52) U.S. Cl. ..... 33/640; 33/42
(58) Field of Search ..... 33/42, 430, 474, 33/640

(56) References Cited

U.S. PATENT DOCUMENTS

| | | | | | |
|---|---|---|---|---|---|
| 1,012,340 | A | * | 12/1911 | Du Pont | 33/474 |
| 2,895,515 | A | * | 7/1959 | Ende | 33/430 |
| 3,927,475 | A | * | 12/1975 | Chang | 33/42 |
| 4,394,800 | A | * | 7/1983 | Griset | 33/42 |
| 4,490,920 | A | * | 1/1985 | Griset | 33/42 |
| 4,503,615 | A | * | 3/1985 | Schreiber | 33/430 |
| 4,926,722 | A | | 5/1990 | Sorensen et al. | 81/487 |
| 5,390,425 | A | * | 2/1995 | Gilberts | 33/474 |
| 5,396,710 | A | * | 3/1995 | Battaglia | 33/474 |
| 5,539,991 | A | * | 7/1996 | Harrison | 33/42 |
| 2003/0192192 | A1 | * | 10/2003 | Kirkland | 33/640 |

OTHER PUBLICATIONS

Harbor Freight Tools, 2002 Catalogue, p. 41 (Crosscut Saw Guide).

* cited by examiner

*Primary Examiner*—G. Bradley Bennett
(74) *Attorney, Agent, or Firm*—Muserlian, Lucas and Mercanti

(57) ABSTRACT

The builder's square aids in cutting sheet material, such as full sheets of plywood, and in particular reduces the time required for cutting. The square comprises a short leg and a long leg connected in an L-shape. The short leg is of greater height than the long leg so that it can bear against one edge of the sheet of plywood to be cut. There is a clamping member at the distal end of the long leg so that the square can be clamped to the plywood. The builder's square also provides improved accuracy and safety for the user.

11 Claims, 2 Drawing Sheets

BUILDER'S SQUARE

The present invention relates to tools and, in particular, to a builder's square which allows quick cutting, especially cross-cutting, of sheet materials such as plywood, Sheetrock, plastic laminates and the like.

BACKGROUND OF THE INVENTION

The square of the present invention can be used by either professional carpenters or homeowners with average skills in woodworking. For ease of reference, the user will generally be referred to herein as a carpenter.

In order to get a straight cut across a sheet of material, e.g. the typical 4' width of plywood and Sheetrock, a carpenter will typically mark the sheet of material (hereinafter referred to as plywood) on each side and then either draw a line between the two marks or clamp a piece of wood an appropriate distance from the line so that a circular saw or other cutting device can be used. This procedure typically requires that the carpenter mark the desired distance on one side of the plywood, walk around the sheet of plywood so that a mark can be made on the other side and then walk back to make the cut. As can be appreciated, this takes a considerable amount of time to complete and, since "time is money," this method has substantial economic drawbacks.

SUMMARY OF THE INVENTION

The applicant herein has now developed a square which overcomes the drawbacks of prior art methods of cutting long or wide sheets of plywood. Applicant's tool is a special form of square that can be used from only one side of the sheet of plywood to be cut, thus eliminating the need to walk around the plywood sheet. The square of the present invention can be used either horizontally, e.g. on a sheet of plywood placed on saw horses, or it can be used vertically, e.g. to cut off a sheet of plywood that has already been mounted to wall studs.

Initially, a single mark is made on the plywood at the appropriate distance for the cut and then the square is put into place. According to the present invention, the square has a short leg and a long leg with the short leg of the square extending below the bottom of the plywood and aligned with the edge of the plywood to be cut. The long leg of the square has a clamping member at the end thereof distal from the short leg of the square. The clamp is operated by a handle connected to a wire which connects to the clamping member at the distal end of the long leg of the square. Springs are preferably included at each end of the wire to ensure that there is constant bias on the clamping member. The carpenter can position the square so that the blade of the cutting tool, e.g. a circular saw, is aligned with the spot where the cut is intended to be made. Either or both of the legs of the square can include measurement markings similar to those used on known builder's squares.

BRIEF DESCRIPTION OF THE DRAWINGS

These and other aspects of the present invention may be more fully understood with reference to the accompanying drawings wherein.

DETAILED DESCRIPTION OF THE INVENTION

Figure 1:
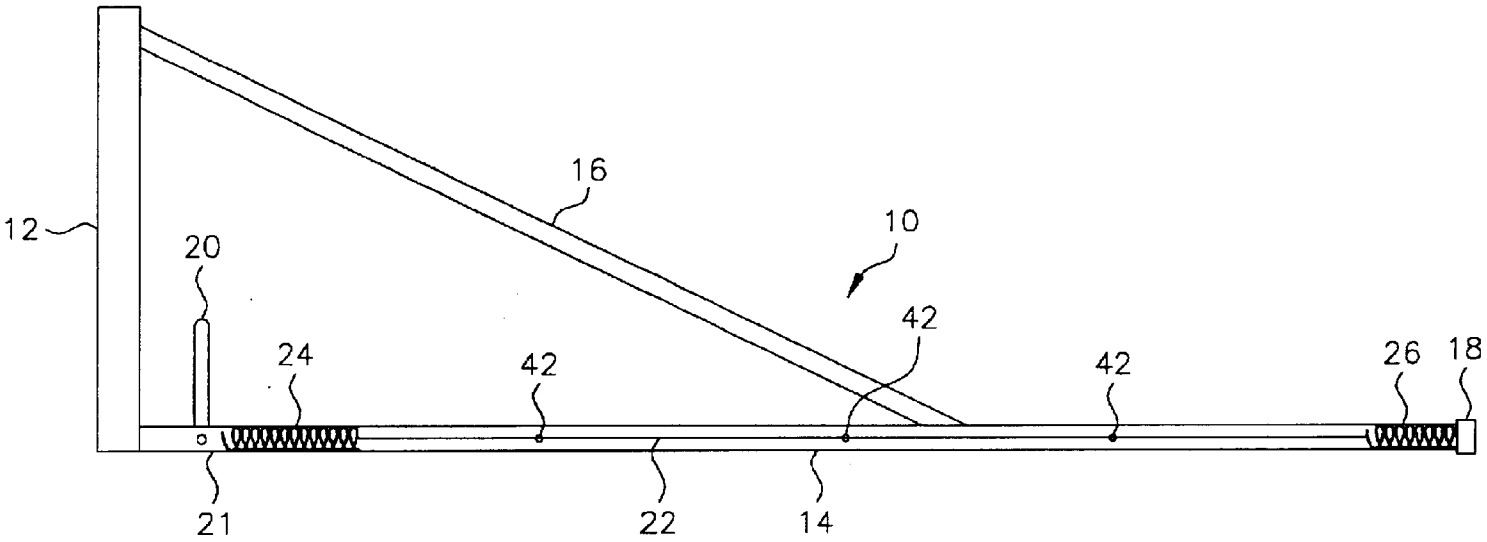
FIG. 1 shows a top view of the square of the present invention.

Referring now to FIG. 1, there is shown a square 10 composed of a short leg 12 and a long leg 14 connected to form an L-shape. As illustrated, there is a support leg 16 which stiffens the entire square and also steadies short leg 12 against the edge of the plywood. It will be appreciated that, while desirable, support leg 16 is not an essential part of the invention.

Figure 2:
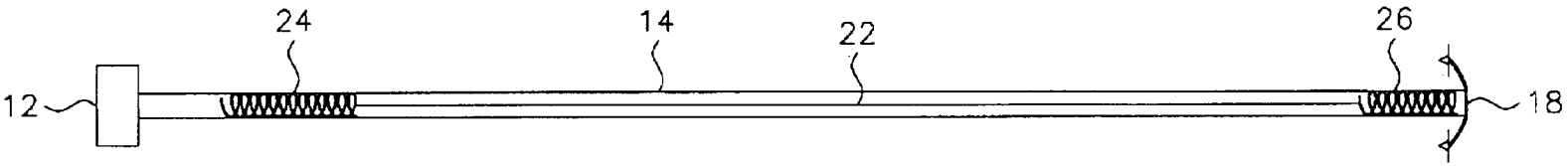
FIG. 2 shows an elevation of the square of the present invention.

Referring to FIG. 2, it can be seen that short leg 12 extends below the surface on which long leg 14 rests. Short leg 12 may also extend above long leg 14 so that the square can be used with short leg 12 to either the right or the left of long leg 14. It is important, however, that short leg 12 not extend beyond the far edge 21 of long leg 14 since this would interfere with one's ability to slide a circular saw or other cutting device along the edge 21 of long leg 14. FIG. 2 also shows a clamping member 18 at the distal end of long leg 14 from short leg 12. As shown, the clamping member is trapped within the sidewalls and top wall of long leg 14. The clamping member is also trapped by the bottom wall (not shown) of long leg 14.

Referring back to FIG. 1, clamping member 18 is actuated by moving handle 20, which pulls cable 22 (which may also be a wire or rod), thus engaging clamping member 18 against the material to be cut. Springs 24 and 26 are preferably provided in order to ensure bias on the clamping member 18 when the handle 20 is moved to the engaged position.

Figure 3:
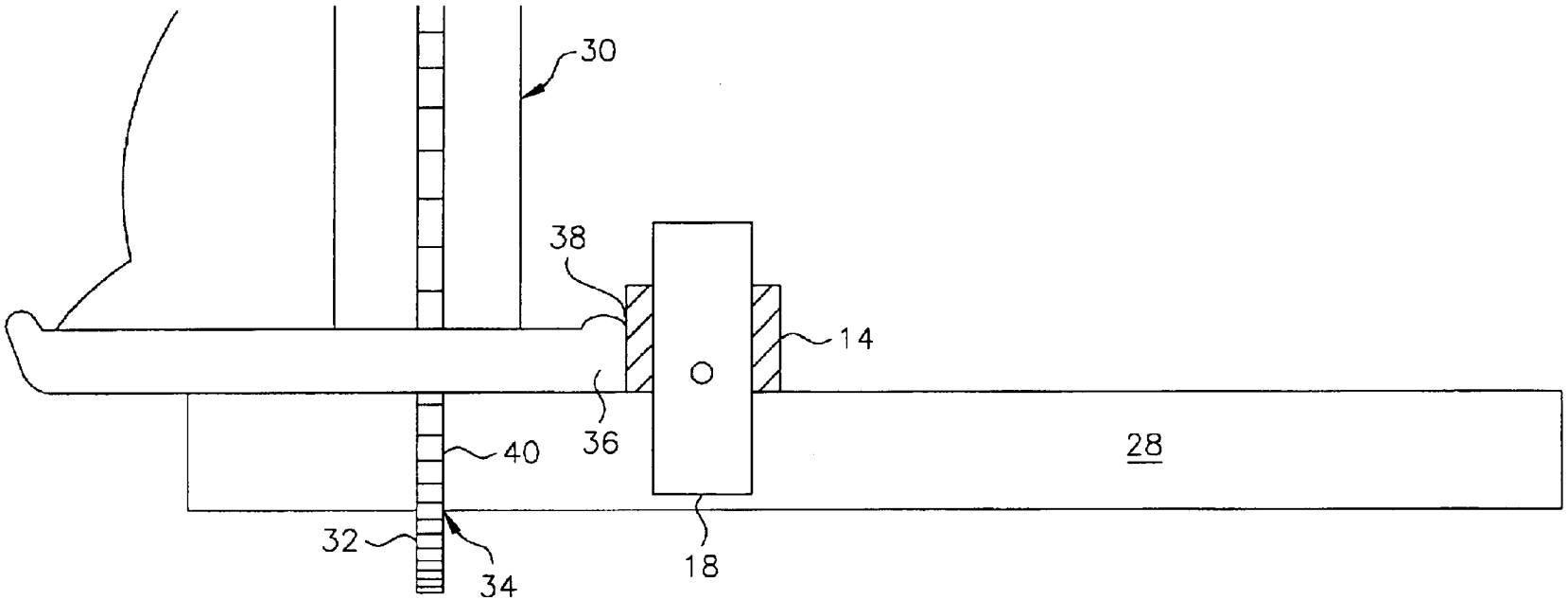
FIG. 3 shows the square of the present invention in use with a circular saw.

Referring now to FIG. 3, there is shown clamping member 18 engaged on a ¾" piece of plywood 28. A circular saw 30 engages the side of long leg 14 of the square. Blade 32 of circular saw 30 cuts along the guide line 34 which has been marked to show where the cut is desired to be made. As can be seen, long leg 14 of the square is so positioned that the base plate 36 of circular saw 30 can press against it with the blade 32 cutting along the line 34. It is noted that the use of clamps with a board is a well-known way of ensuring a straight line. Most homeowners, and certainly all carpenters, know the distance between the edge 38 of base plate 36 and the edge 40 of blade 32 and would thus know where to clamp the square of the present invention to ensure a proper cut.

In the preferred embodiment of the invention, short leg 12, support leg 16 and a portion of long leg 14 form a 30°–60°–90° triangle. Each of legs 12, 14 and 16 is preferably made of aluminum alloy with legs 14 and 16 preferably being hollow squares in cross-section and leg 12 being hollow aluminum which is rectangular in cross-section. The hollow aluminum legs can be perforated to reduce both cost and weight. The preferred dimensions of long leg 14 are a ¾" square with a length of substantially 4 feet. Short leg 12 preferably has a height of 1¼", so that a half-inch extends below the surface of the material to be cut, and a length of 16". Short leg 12 can suitably be made 1¾" in height so that it extends both above and below long leg 14. This is advantageous since it allows the square to be used with short leg 12 extending either to the right or left of long leg 14. Support leg 16 is, like long leg 14, preferably ¾" square and of a length sufficient to make a 30°–60°–90° triangle. Support leg 16 is preferably attached to short leg 12 at the same height that long leg 14 is attached to short leg 12.

While the preferred embodiment of the invention has been described hereinbefore, there are numerous variations which can be made to the preferred embodiment. For example, clamping member 18 could be permanently mounted to long leg 14 and a standard pipe clamp arrangement used for securing the square to the plywood. Similarly, a bar clamp of the type shown in U.S. Pat. No. 4,926,722, the teachings of which are incorporated herein by reference, can be used. The bar clamp of the '722 patent is sold commercially under the name Quick Clamp by the makers of Vise-Grip tools.

The bar clamp described in the '722 patent is operable with one hand and includes a fixed jaw and movable jaw. A one-way drive means, by operation of a trigger handle grip, releasably engages the slide bar and advances the movable jaw towards the fixed jaw. This permits the square of the present invention to be used for cutting wood other than 4 feet in width, e.g. for rip cutting the length of a sheet of plywood. For example, the clamp could be made long enough to grip an 8-foot board and then, since the clamp moves, it could also be used for a lesser dimension, e.g. 6', 4', 2', etc.

An alternative for cutting narrower widths with square 10 of FIG. 1 is to provide nail holes 42 along the length of long leg 14 so that the square can be nailed into place for engaging lengths less than the 4' length of the long leg 14.

A further advantage of the present invention is that it offers improvements in both accuracy and safety. Many carpenters use a device called a Speed Square, especially for the start of cuts on a sheet of plywood, which is held in place by hand. If a carpenter is holding a Speed Square with one hand, he obviously only has the other hand for handling the saw. Furthermore, a hand holding a Speed Square or similar device is in danger of being severely injured if the saw "bucks" from the cut, a situation more likely to occur if the saw is being handled with only one hand rather than two. With the builder's square of the present invention, which utilizes a clamping member, the carpenter can place both hands on the handholds of a circular saw thereby guiding the saw to get a more accurate cut and reducing the likelihood of injury.

It will be understood that the claims are intended to cover all changes and modifications of the preferred embodiments of the invention herein chosen for the purpose of illustration which do not constitute a departure from the spirit and scope of the invention.

What is claimed is:

1. A square to aid in cutting sheet materials, said square comprising:

(a) a long leg having a far edge against which a cutting tool can bear;

(b) a short leg connected to said long leg to form an L-shape, said short leg not extending beyond said far edge of said long leg;

(c) said short leg being greater in height than said long leg and extending both beyond a first surface and beyond a second surface of said long leg such that the short leg is adapted to bear against an edge of said sheet material;

(d) a clamping member at the distal end of said long leg from said short leg, said clamping member being adapted to engage an edge of said sheet material opposite said edge of said sheet material against which the short leg is adapted to bear;

(e) a cable, wire or rod having ends attached to said clamping member at one end and to a handle at the other end; and (f) said handle being operative to move said clamping member into and out of engagement with the edges of said sheet material.

2. The square of claim 1 wherein the long leg is a square metal tube substantially four feet in length.

3. The square of claim 2 wherein the cable, wire or rod passes through the long leg and is attached to the clamping member by a spring and to the handle by a second spring.

4. The square of claim 1 wherein the long leg has holes adapted to receive nails.

5. The square of claim 1 further comprising a support leg attached to said short leg and said long leg to form a triangle.

6. The square of claim 5 wherein the long leg and the support leg are square aluminum alloy tubes having a cross-section of ¾" and the short leg has a height of 1–¼" to 1–¾".

7. A square to aid in cutting sheet materials, said square comprising:

(a) a long leg having a far edge against which a cutting tool can bear;

(b) a short leg connected to said long leg to form an L-shape, said short leg not extending beyond said far edge of said long leg;

(c) said short leg being greater in height than said long leg and extending both beyond a first surface and beyond a second surface of said long leg such that the short leg is adapted to bear against an edge of said sheet material; and (d) a means for clamping the square to opposed edges of said sheet material.

8. The square of claim 7 wherein the long leg is a square metal tube substantially four feet in length.

9. The square of claim 7 wherein the long leg has holes adapted to receive nails.

10. The square of claim 7 further comprising a support leg attached to said short leg and said long leg to form a triangle.

11. The square of claim 10 wherein the long leg and the support leg are square aluminum alloy tubes having a cross-section of ¾" and the short leg has a height of 1–¼" to 1–¾".

* * * * *